US006991496B2

(12) United States Patent
Kuribayashi et al.

(10) Patent No.: US 6,991,496 B2
(45) Date of Patent: Jan. 31, 2006

(54) ELECTRICAL CONNECTOR

(75) Inventors: Nobukazu Kuribayashi, Kariya (JP); Masahiko Sugaya, Anjo (JP); Shigeo Shiba, Toyota (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 10/864,674

(22) Filed: Jun. 9, 2004

(65) Prior Publication Data

US 2004/0253849 A1 Dec. 16, 2004

(30) Foreign Application Priority Data

Jun. 12, 2003 (JP) ..... 2003-167870

(51) Int. Cl.
*H01R 13/66* (2006.01)

(52) U.S. Cl. ..... 439/620; 439/404

(58) Field of Classification Search ..... 439/620, 439/76.1, 404, 925; 361/785, 737, 622, 627
See application file for complete search history.

(56) References Cited

U.S. PATENT DOCUMENTS 4,639,054 A * 1/1987 Kersbergen ..... 439/59
5,037,308 A * 8/1991 Bryce et al. ..... 439/52
5,044,964 A * 9/1991 Minerd et al. ..... 439/67
5,125,846 A * 6/1992 Sampson et al. ..... 439/66
5,314,346 A * 5/1994 Owens et al. ..... 439/189
5,803,355 A 9/1998 Ureshino et al.
6,291,770 B1 * 9/2001 Casperson ..... 174/72 A
6,597,578 B2 * 7/2003 Shiina et al. ..... 361/728
6,741,453 B1 * 5/2004 Aleardi et al. ..... 361/640
2004/0074665 A1 4/2004 Sigaua et al.

FOREIGN PATENT DOCUMENTS

JP 11-275801 10/1999
JP 2001-291558 10/2001
JP 2002-109976 4/2002

* cited by examiner

*Primary Examiner*—Tho D. Ta
*Assistant Examiner*—X. Chung-Trans
(74) *Attorney, Agent, or Firm*—Harness, Dickey & Pierce, PLC

(57) ABSTRACT

An electrical connector has a housing, a circuit board, harness terminals, and contact terminals. The housing has a hole and a lid. The circuit board is detachably disposed in the hole. If the circuit board is broken down, the lid is opened and the circuit board is removed from the hole. A new circuit board is then disposed on the terminals in the hole. The lid is closed so that the terminals are elastically deformed and the electrodes of the circuit board are electrically connected to the terminals.

4 Claims, 13 Drawing Sheets

ELECTRICAL CONNECTOR

CROSS REFERENCE TO RELATED APPLICATION

This application is based on Japanese Patent Application No. 2003-167870 filed on Jun. 12, 2003, the contents of which are incorporated herein by reference.

BACKGROUND OF THE INVENTION

1. Field of the Invention

The present invention relates to an electrical connector. Specifically, the electrical connector is connected to electrical wiring, which is connected to an electrical control unit (ECU), and has a circuit board for controlling a motor-driven actuator.

2. Description of Related Art

A connector having a circuit board for controlling an actuator for driving a door of a vehicle air conditioner is disclosed in JP-A-H11-275801. The connector has a housing, a circuit board, a wire connection, and an actuator connection. The circuit board is disposed within the housing, and a control circuit is mounted on the circuit board. The wire connection is connected to electrical wiring, which is connected to an ECU. The actuator connection is connected to a motor-driven actuator.

In such a connector, the control circuit produces a control signal in response to an input signal from the ECU via the electrical wiring. The control circuit sends the control signal to the motor-driven actuator to control the actuator.

The inventors considered an actuator control system by using the connectors. In the actuator control system, the connectors having the circuit boards are connected in parallel to the electrical wiring extending from the ECU. The connectors are connected to respective actuators. The ECU communicates with the each circuit board of the connector via the electrical wiring. The actuator control system controls a plurality of actuators by using a time division multiple communication.

In such an actuator control system, if one of the circuit boards in the connectors is broken down, all of the connectors and the electrical wiring can be integrally changed to new ones. However, this increases the cost.

Instead, as shown in FIG. 14A-14C, only the connector 90*b* having the broken circuit board may be cut to remove it, and a new connector 90*d* may be electrically connected between connectors 90*a*, 90*c* through the electrical wiring W/H. However, it is difficult to connect the new connector because of the required processes, such as swage process, soldering process, and isolating process.

SUMMARY OF THE INVENTION

An object of the present invention is to provide an electrical connector that can be easily repaired.

According to one aspect of the present invention, the electrical connector has a housing, a circuit board, a harness terminal, and an actuator terminal. The circuit board is detachably housed in the housing. The harness terminal connects a wiring harness to the circuit board. The actuator terminal connects an actuator to the circuit board.

Since the circuit board is detachably housed in the housing, the circuit board can be easily changed without changing the entire structure of the wiring harness and the electrical connector. Therefore, it is easy to repair the circuit board with low cost.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

Figure 1:
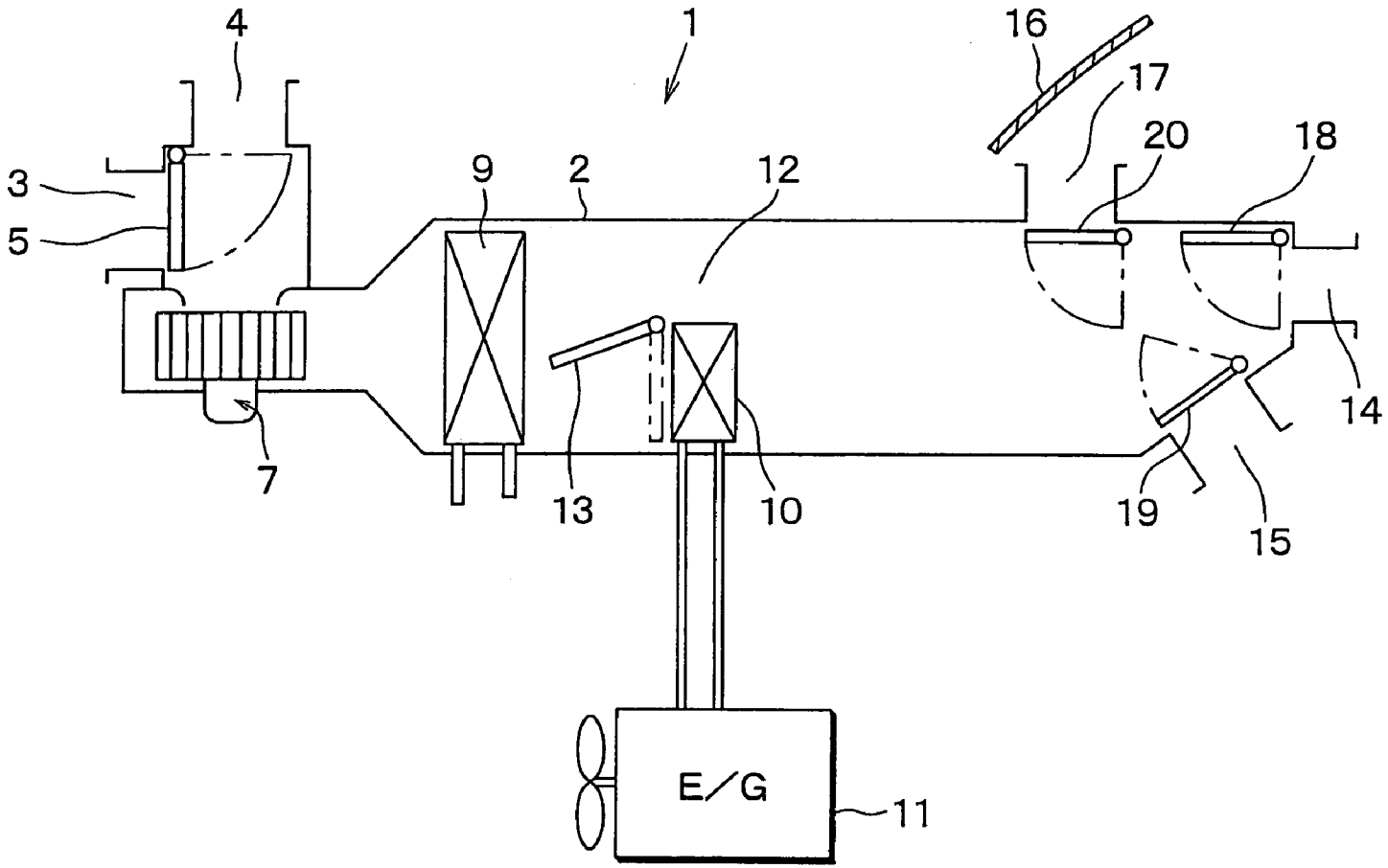
FIG. 1 is a schematic diagram showing an air conditioner for a vehicle according to a first embodiment of the present invention.

The preferred embodiments of the present invention will be explained with reference to the accompanying drawings. In the drawing, the same numerals are used for the same components and devices.

[First Embodiment]

FIG. 1 shows a schematic diagram of an air conditioner 1 for a vehicle according to a first embodiment of the present invention. In the first embodiment, an electrical connector for an actuator is applied to the air conditioner 1.

The air conditioner 1 has an air conditioner casing 2 as an air passage. An inside air suction port 3, an outside air suction port 4, and an inside/outside air switching door 5 are disposed upstream of the air conditioner casing 2. The inside air suction port 3 sucks the inside air. The outside air suction port 4 sucks the outside air. The inside/outside air switching door 5 selectively opens and closes the inside air suction port 3 and the outside air suction port 4.

A filter (not shown) and an air blower 7 are disposed downstream of the inside/outside air switching door 5. The filter removes dust in the air. The air blower 7 sucks the air through the inside and outside air suction ports 3, 4. Then, the air blower 7 blows the sucked air to each air blow port 14, 15, 17.

An evaporator 9 is disposed downstream of the air blower 7. The evaporator 9 cools the air blowing into a vehicle compartment. All of the air blown by the air blower 7 passes through the evaporator 9. A heater core 10 is disposed downstream of the evaporator 9. The heater core 10 heats the air blowing into the vehicle compartment. The heater core 10 uses coolant of an engine 11 as a heat source.

The air conditioner casing 2 has a bypass passage 12. The airflow can bypass the heater core 10 through the bypass passage 12. An air mix door 13 is disposed upstream of the heater core 10. The air mix door 13 adjusts an airflow ratio between the quantity of the airflow flowing through the heater core 10 and the quantity of the airflow flowing through the bypass passage 12 to control the temperature of the air flowing into the vehicle compartment.

A face blowout port 14, a foot blowout port 15, and a defroster blowout port 17 are disposed at the most downstream of the air conditioner casing 2. The face blowout port 14 blows conditioned air toward an upper body of a passenger in the vehicle compartment. The foot blowout port 15 blows the conditioned air toward a lower body of the passenger. The defroster blowout port 17 blows the conditioned air toward an inner surface of a windshield 16 of the vehicle. Blowout mode switching doors 18, 19, 20 are rotatably installed upstream of the face blowout port 14, the foot blowout port 15, and the defroster blowout port 17, respectively.

The blowout mode switching doors 18, 19, 20, the air mix door 13, and the inside/outside air switching door 5 are opened and closed by respective motor-driven actuator 21, such as a servomotor Mo.

Figure 2:
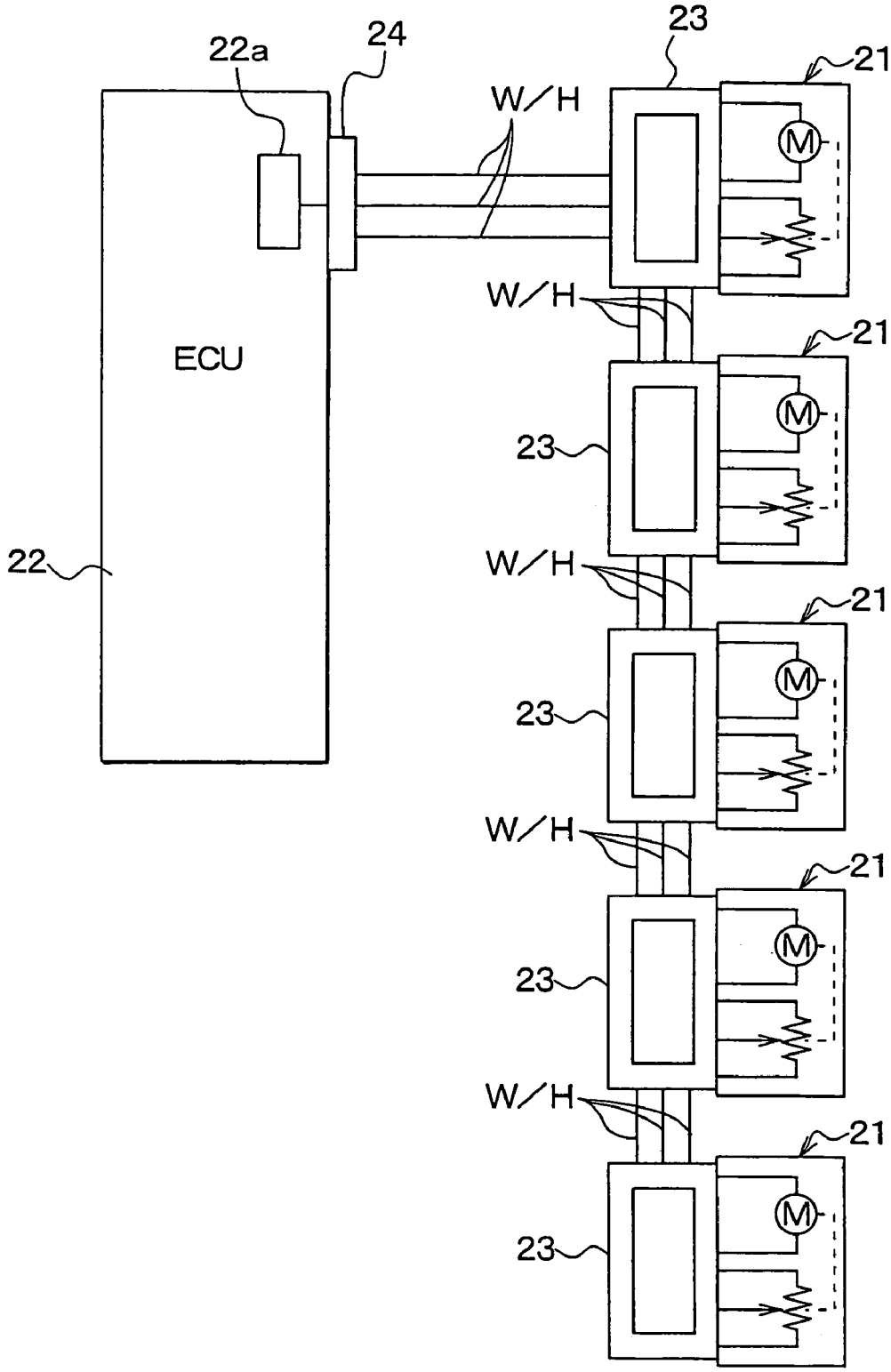
FIG. 2 is a block diagram showing a control system of the air conditioner according to the first embodiment.

FIG. 2 shows a block diagram of a control system of the air conditioner. As shown in FIG. 2, the actuators 21 are connected to respective electrical connectors 23. An ECU 22 has a communication unit 22*a* and an ECU connector 24. The actuators 21 are electrically connected to the communication unit 22*a* of the ECU 22 in series via the ECU connector 24, wiring harnesses W/H, and the electrical connectors 23 for the actuators 21. Each actuator 21 is controlled by the ECU 22.

Figure 3:
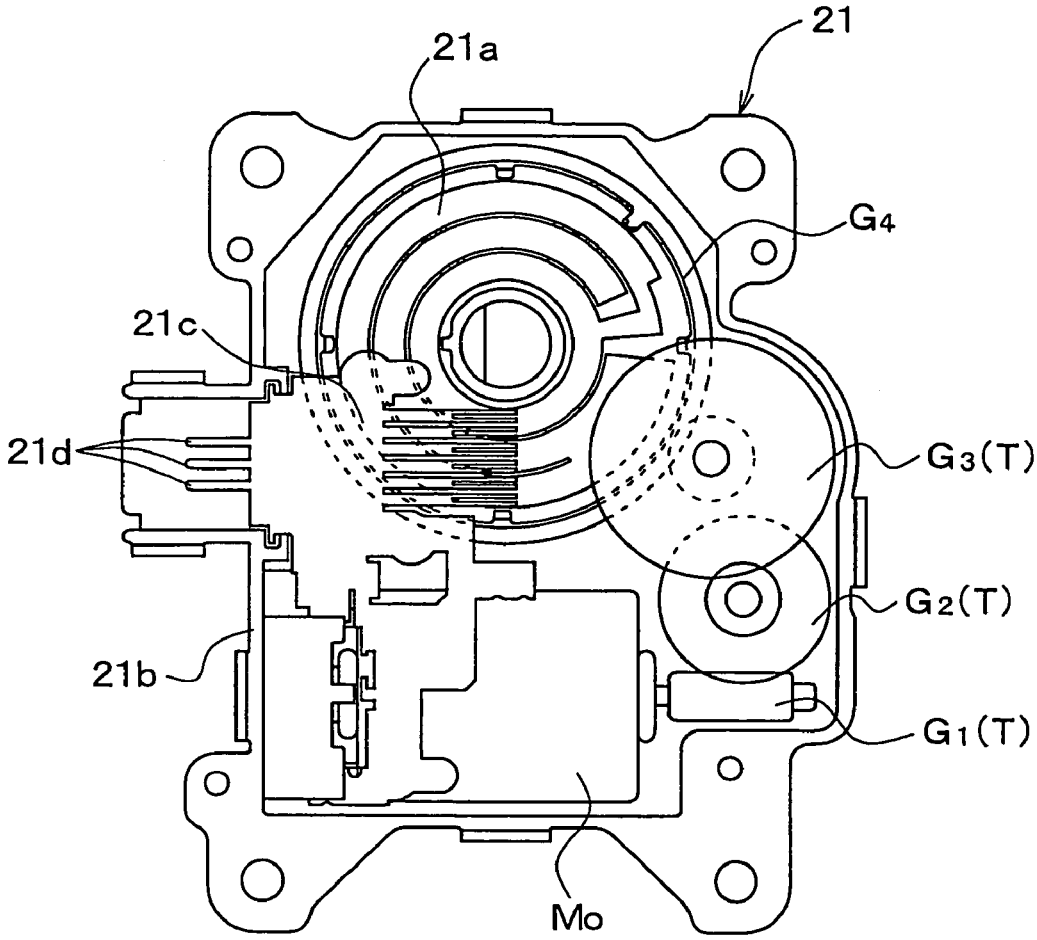
FIG. 3 is a schematic diagram showing an actuator according to the first embodiment.

As shown in FIG. 3, the actuator 21 has the servomotor Mo, a reduction gear T, and an output gear G4. The reduction gear T has a plurality of gears G1, G2, G3. The output gear G4 has a printed board 21*a*. The printed board 21*a* has an arc shaped conductive portion and an arc shaped nonconductive portion. The printed board 21*a* is integrally rotated with the output gear G4. The actuator 21 also has a casing 21*b*. The casing 21*b* has a plate contact 21*c*. The plate contact 21*c* slidably contacts the printed board 21*a*. The plate contact 21*c* and the printed board 21*a* constitute a potentiometer, which detects a rotational angle of the output gear G4.

The casing 21*b* also has male connectors 21*d*. The male connectors 21*d* electrically connect to the plate contact 21*c* and the servomotor Mo. The detected signal for the rotational angle of the output gear G4 and supply current for driving the servomotor Mo are sent and received via the male connectors 21*d*.

Figure 4:
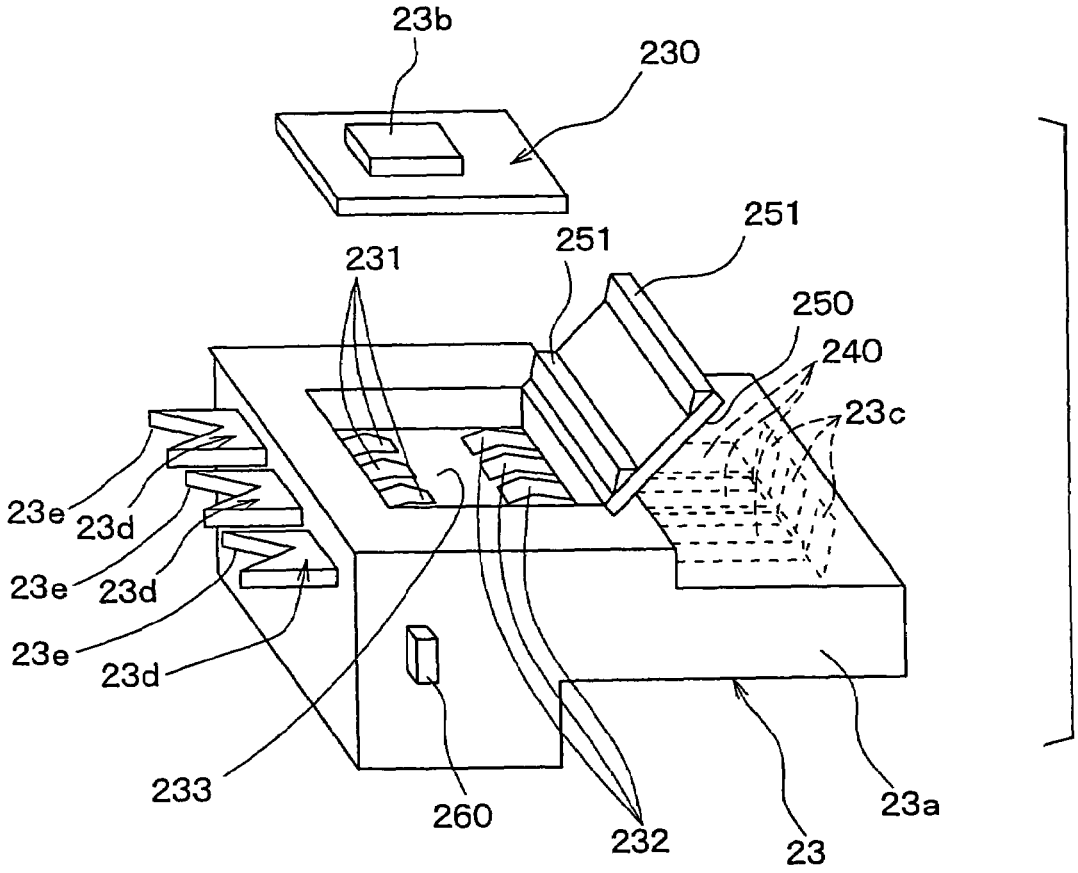
FIG. 4 shows a schematic perspective view of a connector according to the first embodiment.
Figure 5:
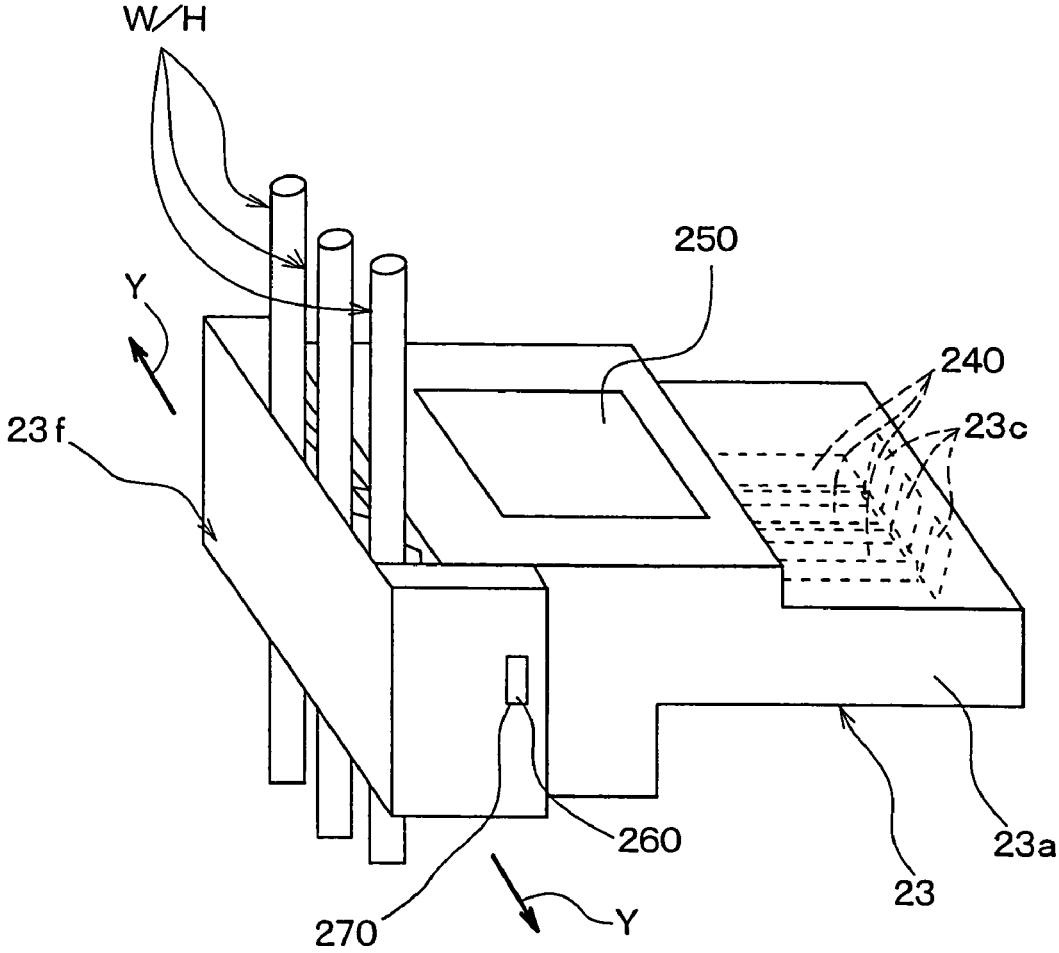
FIG. 5 shows another schematic perspective view of the connector according to the first embodiment.

The electrical connection between ECU 22 and each actuator 21 will be explained with reference to FIGS. 4, 5. FIGS. 4, 5 show schematic diagrams of the electrical connector 23. The electrical connector 23 is connected to an actuator side of the wiring harness W/H, which connects between the ECU 22 and the actuator 21.

As shown in FIGS. 4, 5, the connector 23 has a connector housing 23*a*. The connector housing 23*a* is made of resin, and has a rectangular shape. The connector housing 23*a* has a hole 233. The connector housing 23*a* houses a circuit board 230, first terminals 231, and second terminals 232.

The circuit board 230 is disposed in the hole 233. An integrated circuit (IC) 23*b* is mounted on the circuit board 230. A motor driving circuit and a communication circuit are integrated in the IC 23*b*. That is, they are packed in one chip. The motor driving circuit produces a control signal to control the actuator 21 (the motor Mo). The communication circuit communicates different signals with the motor driving circuit and the ECU 22. The different signals include a signal for controlling the motor driving circuit in response to an input signal from the ECU 22. The different signals also include other signals that are produced from the potentiometer and the motor driving circuit. The motor driving circuit and the communication circuit constitute a control circuit of the present invention.

The first terminals 231 and the second terminals 232 are provided on the bottom of the hole 233. The first terminals 231 are made of phosphor bronze or any other acceptable material. The first terminals 231 are integrally formed with respective harness terminals 23*d*. Each first terminal 231 has a curved shape (a bent shape). The first terminals 231 contact respective first electrodes (not shown) provided on the underside of the circuit board 230.

The second terminals 232 are made of phosphor bronze or any other acceptable material. The second terminals 232 are integrally formed with respective contact terminals 240. Each second terminal 232 has a curved shape (a bent shape). The second terminals 232 contact respective second electrodes (not shown) provided on the underside of the circuit board 230.

The connector housing 23*a* has a lid 250. The hole 233 can be opened and closed by the lid 250. Protrusions 251 are provided on the underside of the lid 250. The protrusions 251 push the circuit board 230 against the first and second terminals 231, 232 when the lid 250 is closed. Accordingly, they improve contact performance between the circuit board 230 and the terminals 231, 232.

The connector housing 23*a* has openings 23*c*, which the male connectors 21*d* of the actuator 21 are plugged into. The contact terminals 240 are provided in respective openings 23*c*. The contact terminals 240 are electrically connected to the respective second terminals 232. The contact terminals 240 contact the male connectors 21*d* of the actuator 21 when the male connectors 21*d* are plugged into the openings 23*c*.

The connector housing 23*a* also has the harness terminals 23*d*. The harness terminals 23*d* are provided so that the harness terminals 23*d* protrude from the connector housing 23*a*. The harness terminals 23*d* are electrically connected to the respective wiring harnesses W/H. The harness terminal 23*d* has V-shape notch 23*e* on its top end. The wiring harness W/H is electrically connected to the harness terminal 23*d* so that the wiring harness W/H is embedded in the V-shape notch 23*e* in a condition that the wiring harness W/H is held between the connector housing 23*a* and a cover 23*f*.

In detail, when the wiring harness W/H is inserted in the V-shape notch 23*e*, insulation coating of the wiring harness W/H is cut by the V-shape notch 23*e*. Thus, a core wire within the insulation coating of the wiring harness W/H is electrically conducted to the harness terminal 23*d*.

As shown in FIG. 5, the cover 23*f* has a C-shape at its cross section, and has joint openings 270. Joint protrusions 260 of the connector housing 23*a* are inserted into the joint openings 270 so that the cover 23*f* is held onto the connector housing 23*a*.

The harness terminals 23*d* have three terminals. One of the harness terminals 23*d* is used as a power line. Another terminal is used as a ground line. The other terminal is used as a command line (data communication line) for the control signal. The control signal is sent and received based on a certain protocol.

Next, a method for assembling the electrical connector 23 will be explained. The male connectors 21*d* of the actuator 21 are inserted into the openings 23*c* of the electrical connectors 23. The male connectors 21*d* contact the respective contact terminals 240. Accordingly, the male connectors 21*d* electrically connected to the respective second terminals 232 via the respective contact terminals 240.

The cover 23*f* is pressed to the connector housing 23*a* in a condition that the wiring harnesses W/H are inserted in the respective V-shape notches 23*e*. At that time, the cover 23*f* is elastically deformed in an arrow direction Y (shown in FIG. 5) so that the cover 23*f* is broadened by the connector housing 23*a*. Then, the joint protrusions 260 are inserted into the joint openings 270. Thus, the cover 23*f* is held onto the connector housing 23*a*.

At the same time, the insulation coating of the wiring harnesses W/H are cut by the V-shape notches 23*e*, so that the core wire within the insulation coating of the wiring harnesses W/H are electrically connected to the harness terminals 23*d*. Accordingly, the wiring harnesses W/H are electrically connected to the respective first terminals 231 via the respective V-shape notch 23*e* and the respective harness terminals 23*d*.

After that, the lid 250 is opened by an operator. The circuit board 230 is disposed on the first and second terminals 231, 232 in the hole 233. Then, the lid 250 is closed, so that the circuit board 230 is pushed by the protrusions 251. The first and second terminals 231, 232 are elastically deformed, and the circuit board 230 is electrically connected to the first and second terminals 231, 232 at the first and second electrodes provided on the underside of the circuit board 230.

If the circuit board 230 is broken down, the lid 250 is opened and the circuit board 230 is removed from the hole 233 by the operator. Then, a new circuit board 230 is provided on the terminals 231, 232 instead of the broken circuit board 230, and the lid 250 is closed. At that time, as described above, the first and second terminals 231, 232 are elastically deformed, and the circuit board 230 is electrically connected to the first and second terminals 231, 232 at the first and second electrodes.

Since the circuit board 230 is detachable in the connector housing 23*a* as described above, it is easy to change the circuit board 230 independently even if the circuit board 230 is broken down. This reduces a cost of the change, and it is easy to repair the electrical connector 23.

[Second Embodiment]

Figure 6A:
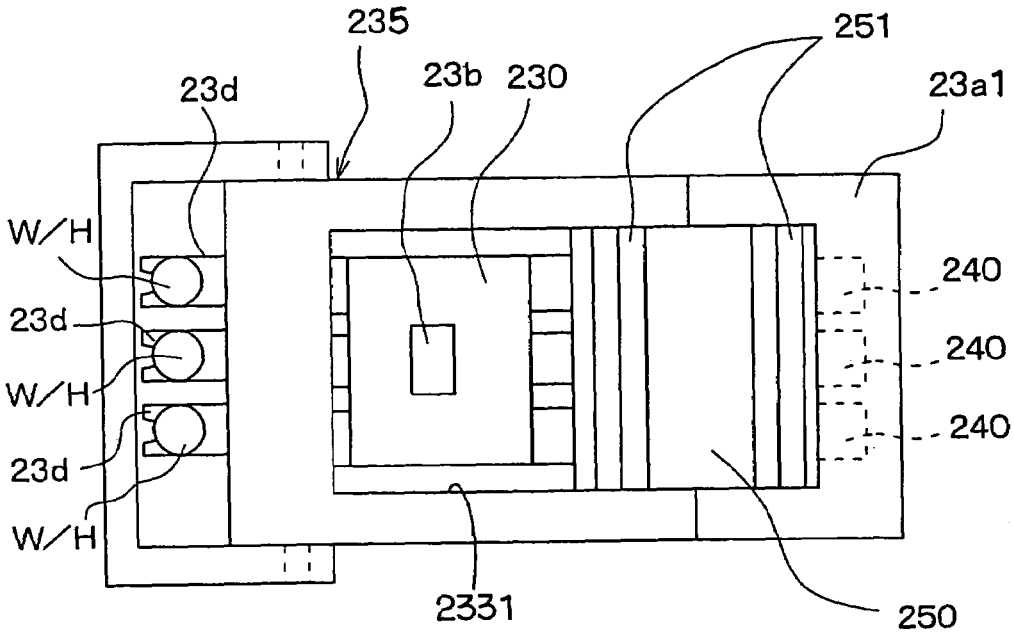
FIG. 6A is a schematic top view of another connector according to a second embodiment of the present invention.
Figure 6B:
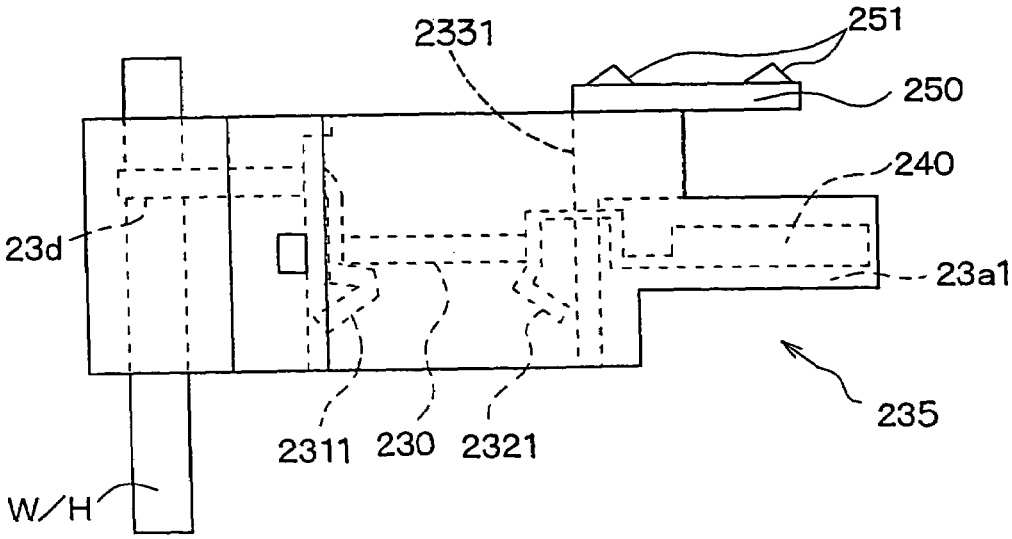
FIG. 6B is a schematic side view of the connector according to the second embodiment.

In the first embodiment, the circuit board 230 is disposed on the first and second terminals 231, 232 in the hole 233 of the connector housing 23*a* so that the circuit board 230 is electrically connected to the terminals 231, 232. Instead, as shown in FIGS. 6A, 6B, the second embodiment uses different first terminals 2311 and different second terminals 2321.

An electrical connector 235 has a connector housing 23*a*1. The connector housing 23*a*1 has a through-hole 2331. The first terminals 2311 and the second terminals 2321 are provided in the through-hole 2331. The first terminals 2311 are disposed on an inner wall of the through-hole 2331, and are connected to the respective harness terminals 23*d*. The second terminals 2321 are disposed on an opposite wall of the through-hole 2331, and are connected to the respective contact terminals 240. The terminals 2311, 2321 are elastically and independently deformed, so that the circuit board 230 is inserted between the first terminals 2311 and the second terminals 2321. Electrodes of the circuit board 230 electrically contact the terminals 2311, 2321 at sides of the circuit board 230.

Figure 7:
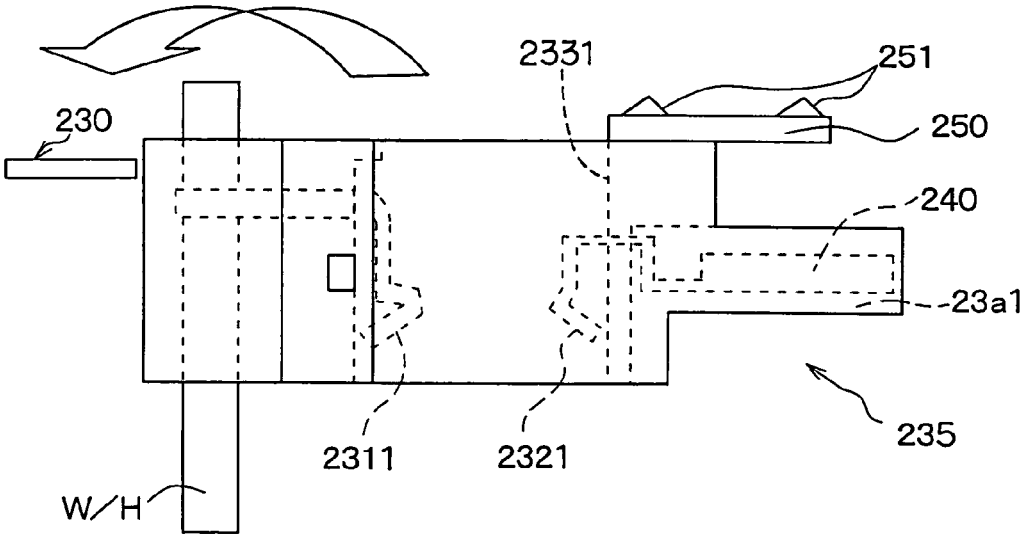
FIG. 7 is a schematic side view of the connector according to the second embodiment.

As shown in FIG. 7, if the circuit board 230 is broken down, the circuit board 230 can be independently changed in the second embodiment as in the first embodiment. This reduces a cost of the change, and it is easy to repair the electrical connector 235.

[Third Embodiment]

In the first and second embodiments, the circuit board 230 is removed from the hole 233 and the through-hole 2331, and the new circuit board 230 is disposed. Instead, as shown in FIGS. 8, 9A–9C, the circuit board 230 is removed by disassembling a dividable connector housing 23*a*2 in the third embodiment.

Figure 8:
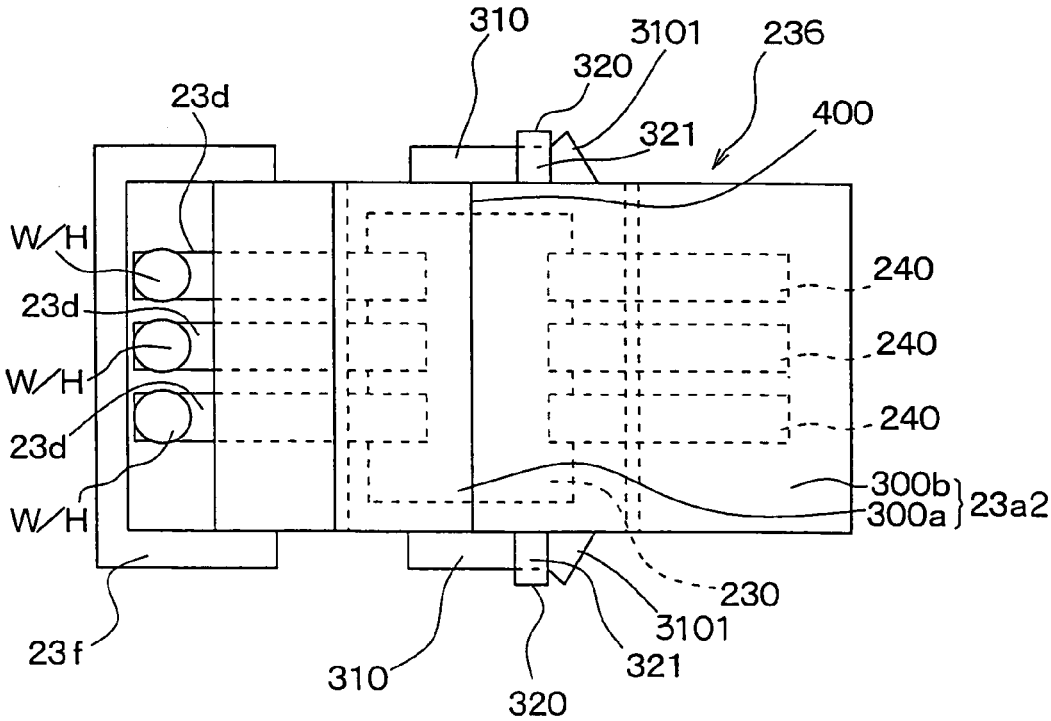
FIG. 8 is a schematic top view of another connector according to a third embodiment of the present invention.

In the third embodiment, as shown in FIG. 8, an electrical connector 236 has the dividable connector housing 23*a*2. The connector housing 23*a*2 has a first housing 300*a* and a second housing 300*b*. The connector housing 23*a*2 can be disassembled into the housings 300*a*, 300*b*.

The first housing 300*a* has joints 310 on both of its sides. The joints 310 protrude toward the second housing 300*b* beyond a dividing surface 400 of the housings 300*a*, 300*b*. The joints 310 have edge portions 3101. The edge portions 3101 are wider than openings 321 of protrusions 320.

The second housing 300*b* has the protrusions 320 on both of its sides. The protrusions 320 have respective openings 321. The joints 310 are inserted into the openings 321, so that the housings 300*a*, 300*b* are connected to each other.

Figure 9A:
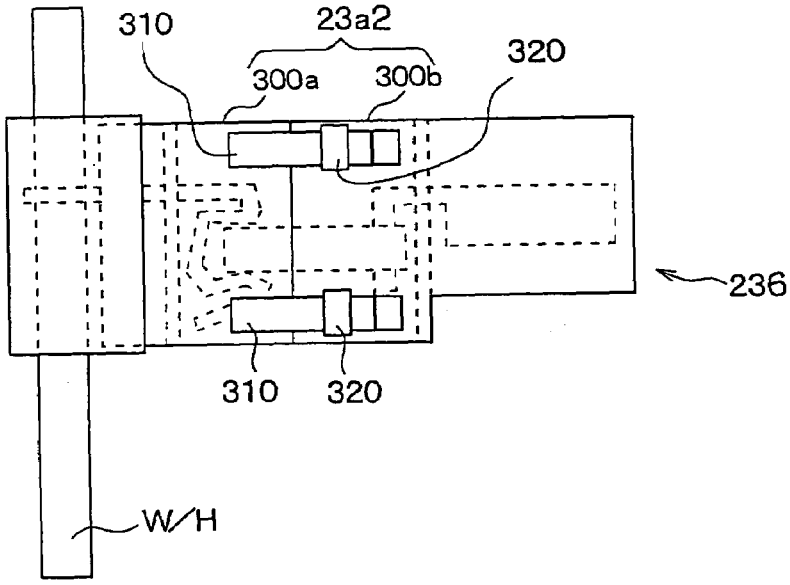
FIG. 9A is a schematic side view of the connector according to the third embodiment;.
Figure 9B:
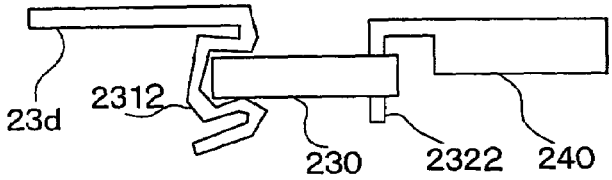
FIG. 9B is a schematic side view of an internal structure of the connector according to the third embodiment.

As shown in FIGS. 9A, 9B, first terminals 2312 are provided in the first housing 300*a*. The first terminals 2312 are elastically deformed, and the circuit board 230 is held on its side by the first terminals 2312. The first terminals 2312 are electrically connected to the electrodes of the circuit board 230.

Second terminals 2322 are provided in the second housing 300*b*. The second terminals 2322 are inserted into the circuit board 230 to be fixed to the circuit board 230. The second terminals 2322 are electrically connected to the electrodes of the circuit board 230.

Figure 9C:
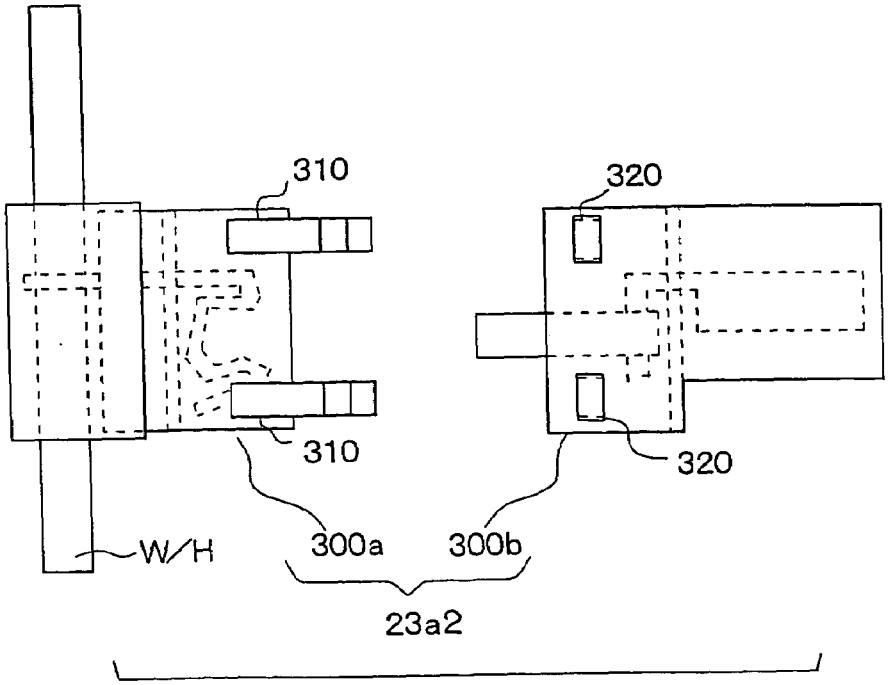
FIG. 9C is a schematic side view of the connector according to the third embodiment.
Figure 10:
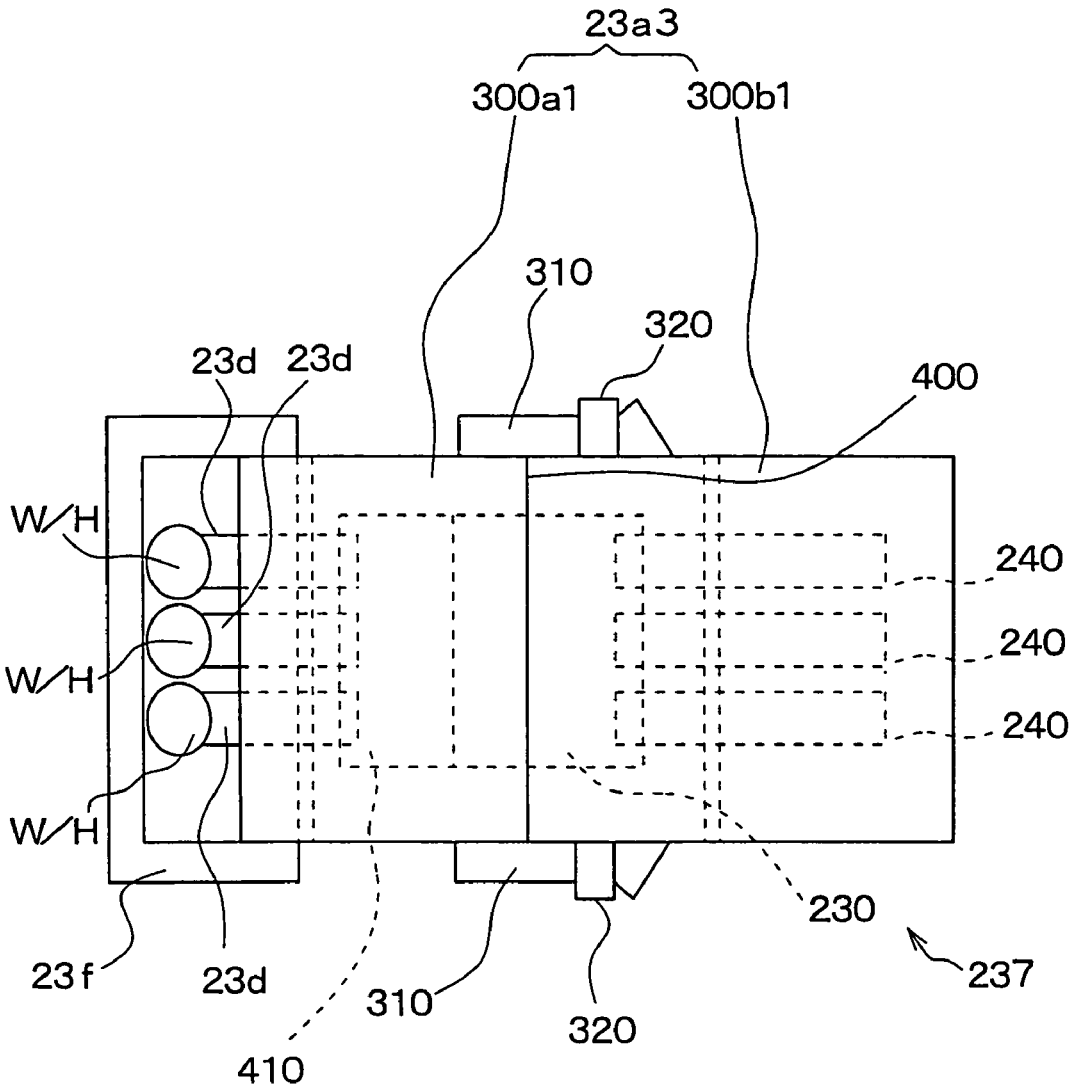
FIG. 10 is a schematic top view of another connector according to a fourth embodiment of the present invention.

As shown in FIG. 9C, if the circuit board 230 is broken down, the connector housing 23*a*2 is disassembled. At that time, the second housing 300*b*, the second terminals 2322, and the circuit board 230 are integrally divided from the first housing 300*a*. The combined part, which has the second housing 300*b*, the second terminals 2322, and the circuit board 230, is changed to a new combined part in order to change the circuit board 230. Instead, the second terminals 2322 and the circuit board 230 may be changed to new parts by further disassembling from the second housing 300*b*.

[Fourth Embodiment]

In the third embodiment, the circuit board 230 is held on its side by the first terminals 2312 in the first housing 300*a*, and the first terminals 2312 are electrically connected to the electrodes of the circuit board 230. Instead, as shown in FIGS. 10, 11A–11C, different first terminals 2313 are electrically connected to the electrodes of the circuit board 230 via a relay board 410.

In the fourth embodiment, an electrical connector 237 has a dividable connector housing 23*a*3. The connector housing 23*a*3 has another first housing 300*a*1 and another second housing 300*b*1. The connector housing 23*a*3 can be disassembled into the housings 300*a*1, 300*b*1. The first terminals 2313 are provided in the first housing 300*a*1.

The relay board 410 is made of conductive metal. The first terminals 2313 are inserted through the relay board 410, and the relay board 410 is fixed to the first terminals 2313. The relay board 410 is electrically connected to electrodes provided on the surface of the circuit board 230 at the backside of the relay board 410. Thus, the first terminals 2313 are electrically connected to the circuit board 230 via the relay board 410.

Figure 11A:
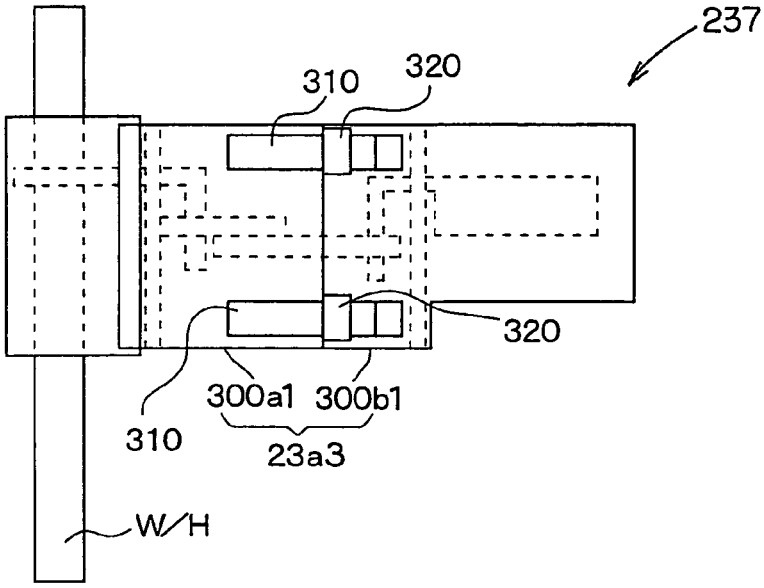
FIG. 11A is a schematic side view of the connector according to the fourth embodiment.
Figure 11B:
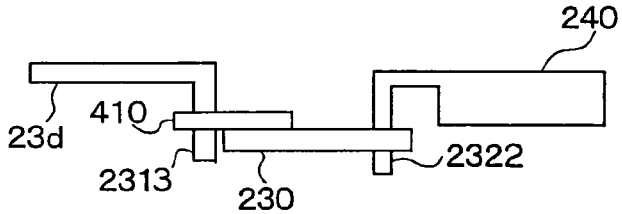
FIG. 11B is a schematic side view of an internal structure of the connector according to the fourth embodiment.
Figure 11C:
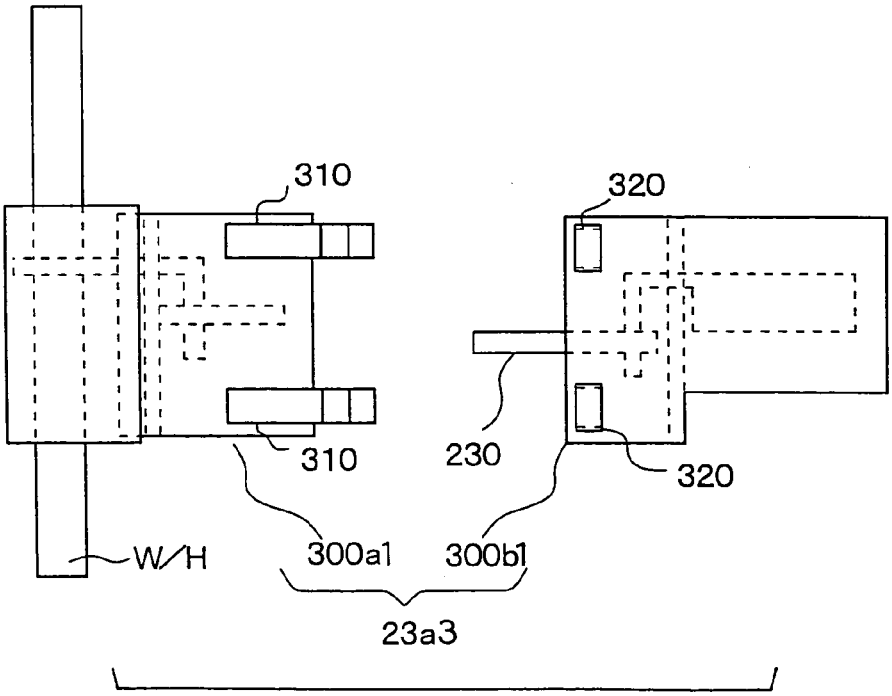
FIG. 11C is a schematic side view of the connector according to the fourth embodiment.
Figure 12:
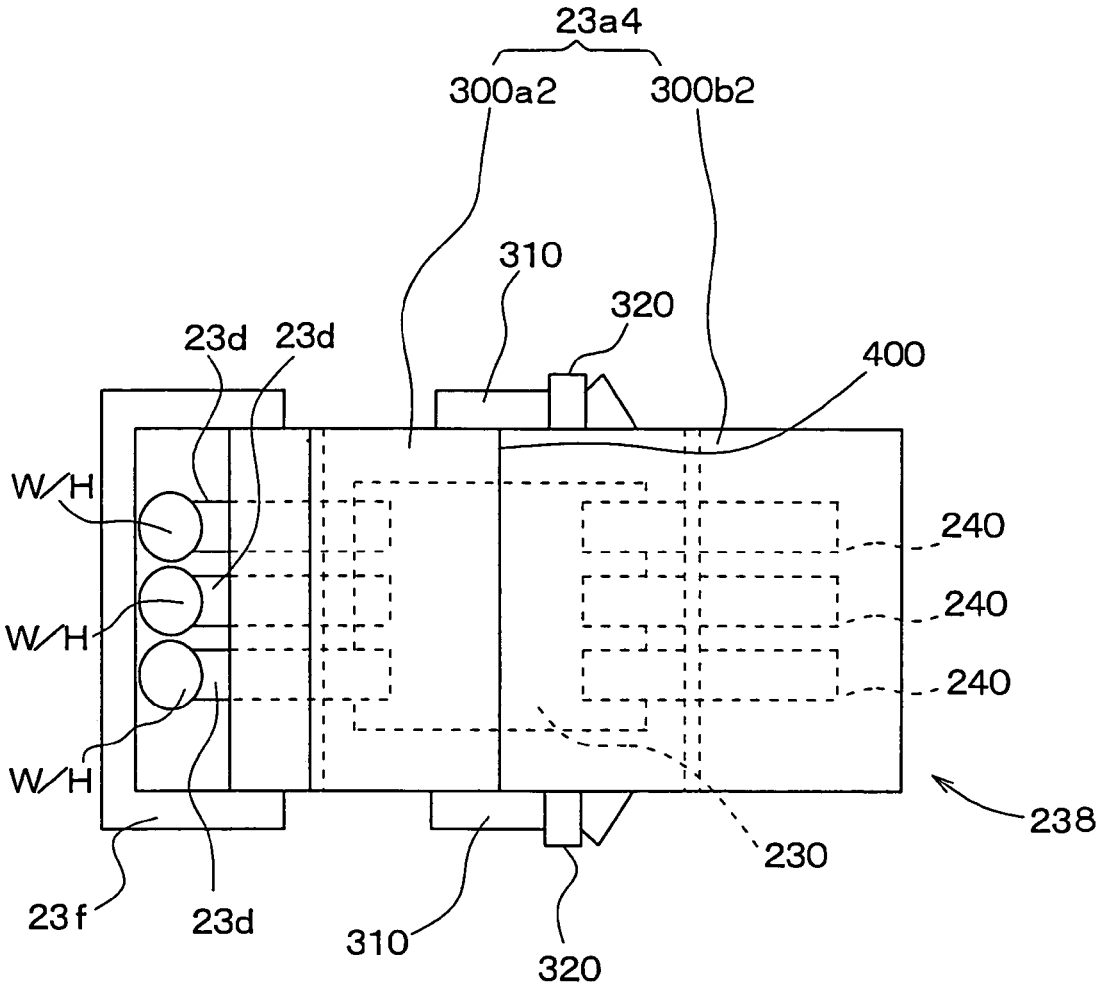
FIG. 12 is a schematic top view of another connector according to a fifth embodiment of the present invention.

As shown in FIG. 11C, if the circuit board 230 is broken down, the connector housing 23*a*3 is disassembled. At that time, the second housing 300*b*1, the second terminals 2322, and the circuit board 230 are integrally divided from the first housing 300*a*1 as in the third embodiment. The circuit board 230 is changed to a new circuit board 230 by changing the combined part, which has the second housing 300*b*1, the second terminals 2322, and the circuit board 230.

[Fifth Embodiment]

In the third and fourth embodiments, the second housings 300*b*, 300*b*1, the second terminals 2322, and the circuit boards 230 are integrally divided from the first housings 300*a*, 300*a*1. Instead, as shown in FIGS. 12, 13A–13C, the circuit board 230 can be independently changed by disassembling a dividable connector housing 23*a*4 in the fifth embodiment.

In the fifth embodiment, an electrical connector 238 has the dividable connector housing 23*a*4. The connector housing 23*a*4 has a first housing 300*a*2 and a second housing 300*b*2. The connector housing 23*a*4 can be disassembled into the housings 300*a*2, 300*b*2.

Figure 13A:
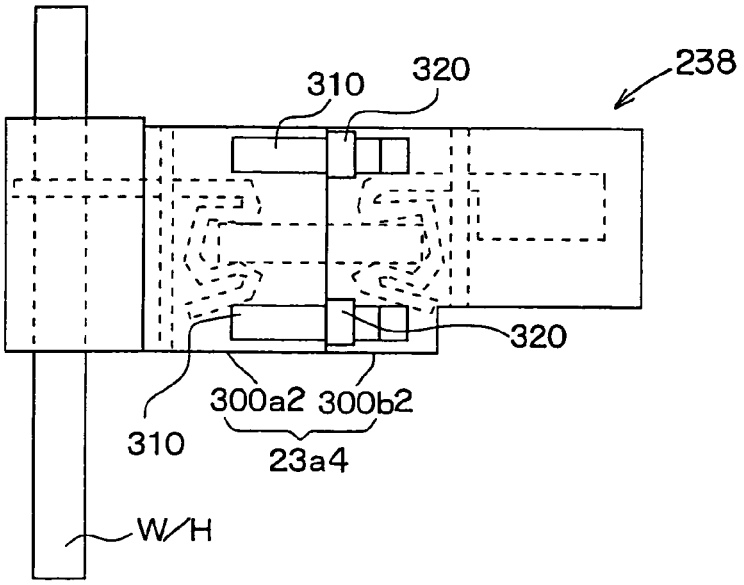
FIG. 13A is a schematic side view of the connector according to the fifth embodiment.
Figure 13B:
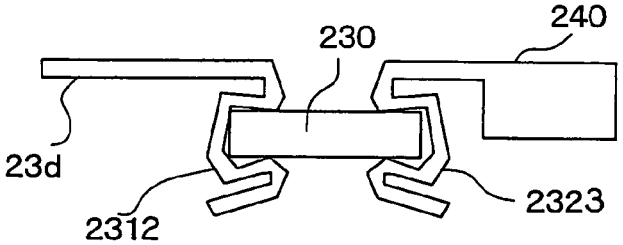
FIG. 13B is a schematic side view of an internal structure of the connector according to the fifth embodiment.
Figure 13C:
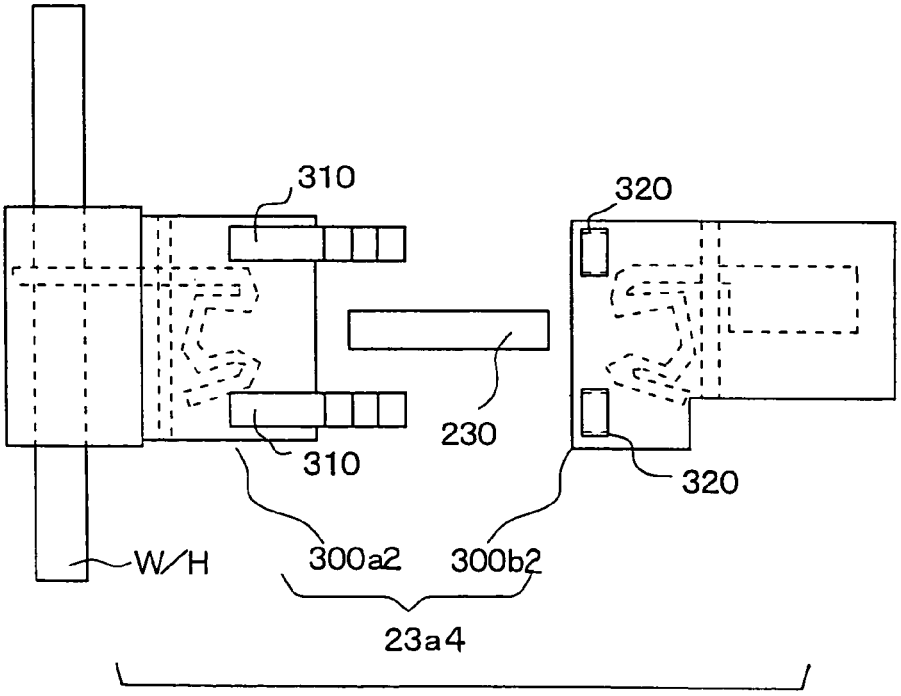
FIG. 13C is a schematic side view of the connector according to the fifth embodiment.
Figure 14A:
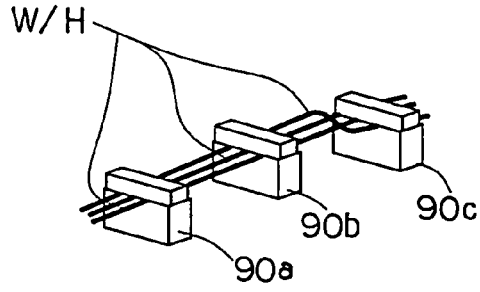
FIG. 14A RELATED ART
FIGS. 14A–14C show a connector according to a related art.
Figure 14B:
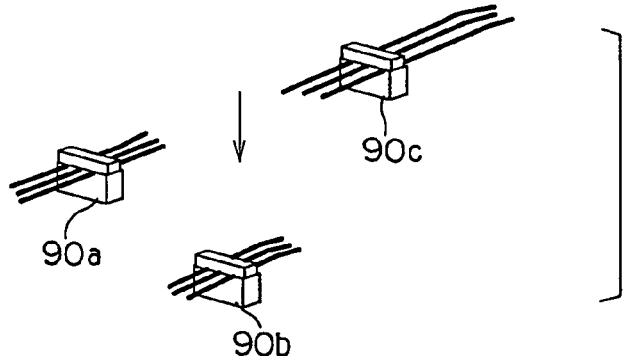
FIG. 14B RELATED ART
Figure 14C:
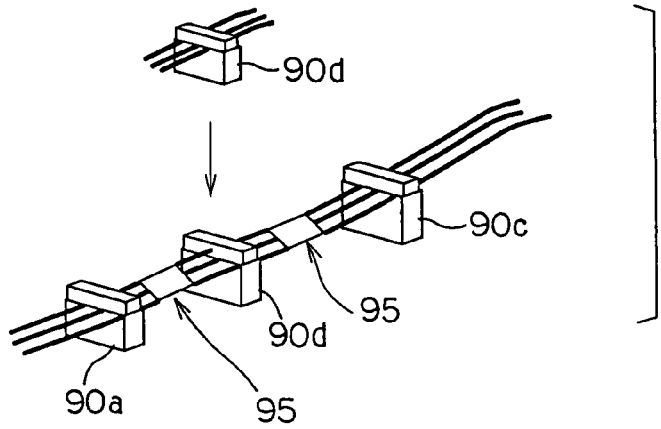
FIG. 14C RELATED ART

As shown in FIGS. 13A, 13B, the first terminals 2312 are provided in the first housing 300*a*2, and second terminals 2323 are provided in the second housing 300*b*2. Each of the first and second terminals 2312, 2323 has a curved shape (a bent shape) so that the first and second terminals 2312, 2323 are elastically and independently deformed and the circuit board 230 is electrically held between the first terminals 2312 and the second terminals 2323. Therefore, if the circuit board 230 is broken down, the circuit board 230 is independently changed by disassembling the connector housing 23*a*4.

[Another Embodiment]

The present invention should not be limited to the embodiments discussed above and shown in the figures, but may be implemented in various ways without departing from the spirit of the invention.

For example, in the foregoing embodiments, the wiring harnesses W/H are inserted in the V-shape notches 23*e*, so that the core wires within the insulation coating of the wiring harnesses W/H are electrically connected to the harness terminals 23*d*. Instead, the core wires can be electrically connected to the harness terminals 23*d* by other methods, such as soldering, pressure welding, and pressing.

In the foregoing embodiments, the electrical connector for the actuator is applied to the vehicle air conditioner. Instead, the electrical connector can be applied to other control systems for other actuators using other networks.

What is claimed is:

1. An electrical connector for connecting an actuator to a wiring harness connected to an electrical control unit, the electrical connector comprising:

a housing having a first housing section and a second housing section;

a circuit board that is detachably housed in the housing and has a control circuit that produces a control signal to control the actuator based on an input signal from the electrical control unit via the wiring harness;

a harness terminal that connects the wiring harness to the circuit board;

an actuator terminal that connects the actuator to the circuit board; and a first terminal that is housed in the first housing section and is electrically connected to the harness terminal and the circuit board;

a second terminal that is housed in the second housing section and is electrically connected to the actuator terminal and the circuit board;

a relay board that is electrically fixed to the first terminal; wherein the second terminal is fixed to the circuit board, and the relay board is electrically connected to the circuit board when the first housing section and the second housing section are combined with each other.

2. The electrical connector according to claim 1, wherein the harness terminal has a V-shape notch that cuts insulation coating of the wiring harness so that a core wire within the insulation coating of the wiring harness is electrically connected and held.

3. The electrical connector according to claim 1, wherein:

the relay board is made of a conductive metal;

the first terminal is inserted through the relay board, and the relay board is fixed to the first terminal;

the relay board is electrically connected to electrodes provided on a surface of the circuit board at a backside of the relay board; and the first terminal is electrically connected to the circuit board via the relay board.

4. The electrical connector according to claim 3, wherein:

the second housing section, the second terminal and the circuit board are integrally divided from the first housing section, when the housing is disassembled into the first housing section and the second housing section.

* * * * *